US005464334A

United States Patent [19]

Cook et al.

[11] Patent Number: 5,464,334

[45] Date of Patent: Nov. 7, 1995

[54] FUEL INJECTION PUMP

[75] Inventors: Graeme A. C. Cook; Goulielmos Vranas; Simon P. McIver, all of Gloucesterhire, England

[73] Assignee: Lucas Industries plc, England

[21] Appl. No.: 328,974

[22] Filed: Oct. 24, 1994

Related U.S. Application Data

[63] Continuation of Ser. No. 163,975, Dec. 8, 1993, abandoned.

[30] Foreign Application Priority Data

Dec. 8, 1992 [GB] United Kingdom ..... 9225585

[51] Int. Cl.[6] ..... F04B 7/04

[52] U.S. Cl. ..... 417/494

[58] Field of Search ..... 417/494

[56] References Cited

U.S. PATENT DOCUMENTS

| | | | |
|---|---|---|---|
| 2,438,251 | 3/1948 | Pedersen | 417/494 |
| 4,957,418 | 9/1990 | Pischingen et al. | 417/494 |
| 5,032,066 | 7/1991 | Baty | 417/494 X |

*Primary Examiner*—Richard E. Gluck
*Attorney, Agent, or Firm*—Jenner & Block

[57] ABSTRACT

A fuel injection pump has a cam actuated plunger which is moved inwardly in a bore to displace fuel through an outlet. A port is formed in the wall of the bore and at some position during the inward movement of the plunger is uncovered by a control edge to allow fuel to escape from the bore. In order to damp the final inward movement of the plunger a further edge of the groove progressively covers the port so as to restrict the rate at which fuel can escape through the port.

7 Claims, 1 Drawing Sheet

FUEL INJECTION PUMP

This application is a continuation of application Ser. No. 08/163,975, filed Dec. 8, 1993, now abandoned.

This invention relates to fuel injection pumps for supplying fuel to an internal combustion engine the pumps being of the kind comprising a pumping plunger slidable within a bore, an outlet from one end of the bore, the outlet being connected in use, to a fuel injection nozzle of an associated engine, the nozzle incorporating a fuel pressure actuated valve member, a coiled compression spring biasing the plunger outwardly of the bore, the plunger being movable inwardly by the action of an engine driven cam against the action of the spring, and spill means for spilling fuel from the bore during the inward movement of the plunger thereby to control the amount of fuel supplied to the associated engine.

In a known form of pump the means for spilling fuel comprises a groove on the plunger which is in communication with the inner end of the bore. The groove is provided with an inclined edge which at a predetermined position during the inward movement of the plunger and depending upon the angular setting of the plunger, uncovers a port formed in the wall of the bore and allows fuel to escape from the inner end of the bore. Prior to the port being uncovered, the fuel pressure in the one end of the bore is extremely high and considerable force has to be applied to the plunger leading to substantial mechanical loading of the components of the engine which contribute to the inward movement of the plunger. When the port is uncovered the fuel pressure is released and there is a tendency for the plunger to overtravel due to the release of the energy stored in the aforesaid components. Such overtravel of the plunger can result in mechanical damage.

One solution would be to provide a stronger spring however, the provision of a stronger spring would mean that the force required to actuate the plunger would be increased and furthermore, additional space would be required to accommodate the spring.

The object of the invention is to provide a pump of the kind specified in an improved form.

According to the invention a pump of the kind specified includes means operable to damp the final movement of the pumping plunger after the spill means has operated to spill fuel from the bore.

Figure 1:
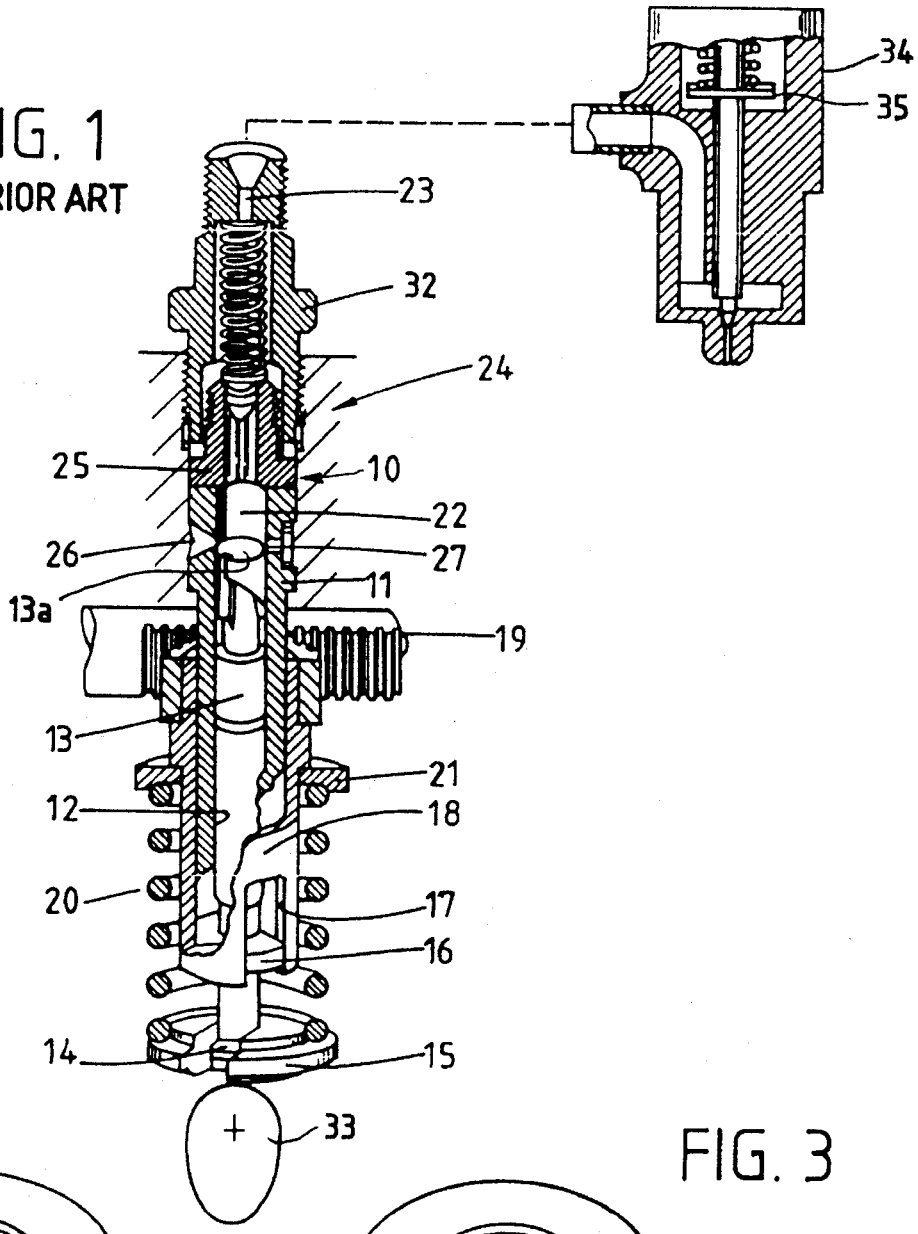
FIG. 1 PRIOR ART
Figure 2:
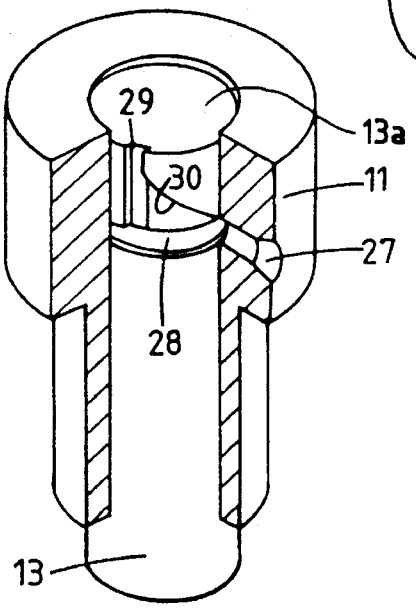
FIG. 2 PRIOR ART
Figure 3:
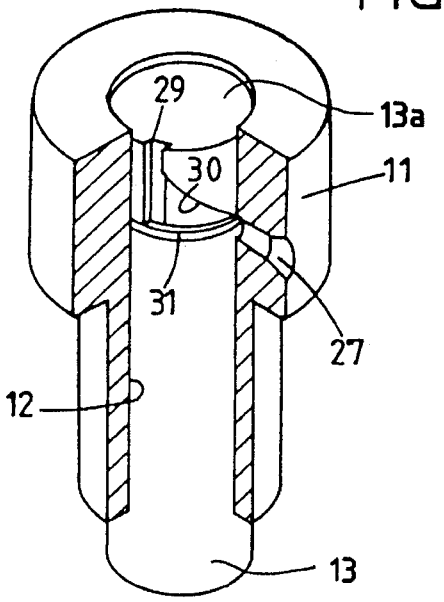

In the accompanying drawings:

FIG. 1 is a part sectioned perspective view of one example of a prior art pump to which the invention may be applied, FIG. 2 is a view to an enlarged scale of a portion of the pump shown in FIG. 1 with two parts thereof in a different position, and FIG. 3 is a view corresponding to FIG. 2 showing the modification in accordance with the invention.

Referring to FIG. 1 of the drawings the pump comprises a body part 10 in which is mounted a pump barrel 11 within which is formed a bore 12. Slidable within the bore is a pumping plunger 13 which projects from the outer end of the bore. The outer end of the plunger is provided with a head 14 upon which is mounted a spring abutment 15 and intermediate the outer end of the pump barrel and the head 14 the plunger is provided with a pair of outwardly extending dogs 16 which are slidable within slots 17 respectively formed in a sleeve 18 which is mounted about the pump barrel. The sleeve is provided with teeth engaged with a rack bar 19 which in use, is connected to a governor mechanism. Linear movement of the rack bar results in angular movement of the sleeve and the plunger but at the same time the plunger can be moved inwardly with the dogs 16 sliding within the slots 17.

A coiled compression spring 20 is interposed between the abutment 15 and a further abutment 21 and the head 14 is engagable by an engine driven component 33 to effect inward movement of the plunger against the action of the spring. The cam 33 can operate against the plunger through a follower or by way of a rocker. The outward movement of the plunger is effected by the spring.

The inner end 13*a* of the pumping plunger together with the bore 12 form a pumping chamber 22 which is connected to an outlet 23 by means of in the particular example, an unloading delivery valve 24 which is mounted in a valve housing 25. The valve housing is maintained in sealing engagement with the adjacent end of the barrel by means of an outlet union 32 which is in screw thread engagement with the body 10.

Formed in the wall of the bore is a pair of diametrically opposed ports 26, 27 which communicate with a fuel supply gallery (not shown) formed in the body part 10 and which is connected in use, to a source of fuel at low pressure. The ports 26, 27 are uncovered by the end 13*a* of the plunger at the outward limit of its travel as shown in FIG. 1.

As more clearly seen in FIG. 2 there is formed on the plunger a circumferential groove 28 and this is in communication with the pumping chamber 22 by way of an axially extending groove 29. In addition, the grooves 28 and 29 are extended up to a helical control edge 30.

In operation, the pumping chamber is completely filled with fuel when the ports 26 and 27 are uncovered by the end of the plunger towards the limit of its outward movement. As the plunger is moved inwardly fuel will be displaced from the pumping chamber through the ports 26, 27 until they are again covered by the plunger. Thereafter, the fuel in the pumping chamber is pressurised to a sufficient extent to lift the delivery valve member from its seating so that fuel can flow to the associated injection nozzle. The injection nozzle 34 contains a fuel pressure actuated valve 35 and when the pressure is sufficiently high the valve 35 is lifted to allow fuel flow into a combustion chamber of the associated engine. This flow of fuel will continue so long as the plunger is moving inwardly and the ports 26 and 27 are covered. The helical edge 30 however depending upon the angular position of the plunger will uncover the port 27 and when this takes place the fuel in the pumping chamber can flow along the groove 29 and out through the port 27. This results in a rapid reduction of the fuel pressure within the pumping chamber 22 and consequent closure of the delivery valve and the valve member 35 of the nozzle 34. The rapid reduction in pressure however means that the inward movement of the pumping plunger is restrained only by the action of the spring 20 and the stored energy in the components of the engine contributing to the inward movement of the plunger is released and can cause sudden inward movement of the plunger to the extent that at high speeds and particularly at high rates of delivery, it could physically engage the end wall of the pumping chamber which is constituted by the delivery valve housing 25.

In order to prevent engagement of the plunger with the delivery valve housing it is proposed to provide damping of the movement of the plunger and as shown in FIG. 3, this can be effected by reducing the axial width of the circumferential groove 28 as shown at 31 in FIG. 3. The effect of reducing the axial width of the groove is that a further edge of the groove effects partial closure of the port 27 as the plunger attains its innermost position. The spillage of fuel from the pumping chamber is not affected by reducing the axial width of the groove but in the event that there is any tendency for the plunger to overshoot, the port will be further closed if not closed completely and the fuel remaining in the pumping chamber will be pressurised and will therefore provide a damping action. It is important to ensure that at normal maximum speed, the pressurisation of the fuel is not sufficient to lift the valve member 35 in the fuel injection nozzle 34 otherwise further fuel will be delivered to the engine.

A damping effect can be achieved by careful control of the cross sectional area of the groove 29. In this case however care has to be taken to ensure that the restriction of the groove does not reduce to any material extent the rate at which fuel is spilled from the pumping chamber when the port is uncovered.

We claim:

1. A fuel injection pump for supplying fuel to an internal combustion engine comprising a pumping plunger slidable within a bore, an outlet from one end of the bore, the outlet being connected in use, to a fuel injection nozzle of an associated engine, the nozzle incorporating a fuel pressure actuated valve member, a coiled compression spring biasing the pumping plunger outwardly of the bore, the pumping plunger being movable inwardly by the action of an engine driven cam against the action of the spring, spill means for spilling fuel from the bore during the inward movement of the pumping plunger thereby to control the amount of fuel supplied to the associated engine, and fluid damping means for restricting the final inward movement and for restricting overtravel of the pumping plunger, said fluid damping means producing an increase in the pressure in the bore above the pumping plunger while the spill means operates to spill fuel from the bore and before the pumping plunger attains its innermost position.

2. A fuel pump according to claim 1, in which said damping means acts to restrict the rate at which fuel can escape from said bore through said spill means.

3. A fuel pump according to claim 1, in which said spill means comprises a port formed in the wall of said bore, and a groove formed in the plunger, said groove communicating with said one end of the bore and the groove having an inclined edge which at a predetermined position during the inward movement uncovers said port to said one end of the bore thereby to allow fuel to spill from the bore.

4. A fuel pump according to claim 3, in which said groove defines a further edge which moves across said port as the plunger moves inwardly, thereby to restrict the rate at which fuel can flow through said port.

5. A fuel pump according to claim 3, including a further groove which connects said first mentioned groove with said end of the bore, said further groove having a controlled cross sectional area.

6. A fuel injection pump for supplying fuel to an internal combustion engine comprising a pump lunger slidable in a bore, an outlet extending from one end of the bore, the outlet being connected in use to fuel injection nozzle having a fuel pressure actuated valve member, a coiled compression spring biasing the plunger outwardly of the bore, the plunger being movable inwardly by the action of an engine driven cam to displace fuel from the bore through said outlet, a port formed in the wall of the bore, said port being positioned to be covered by the plunger during the initial inward movement of the plunger, and groove means formed in a side wall of the plunger, said groove means including an inclined control edge which uncovers said port at a predetermined position during inward movement of the plunger depending upon the angular setting of the plunger within the bore, said groove means including a groove which has a predetermined axial width and which operably connects with said one end of the bore, said groove being positioned and the predetermined axial width chosen so that the groove causes an increase in fluid pressure in the bore after the port is uncovered during inward movement of the plunger before the plunger attains its innermost position for restricting further inward travel of the plunger.

7. A fuel injection pump for supplying fuel to an internal combustion engine comprising a pump plunger having an inner end and a head and slidably positioned within at least a portion of a bore, an outlet extending from one end of the bore, the outlet being connected in use to a fuel injection nozzle having a fuel pressure actuated valve member, a pumping chamber defined in part by said inner end of said plunger and said one end of said bore, a coiled compression spring biasing the plunger outwardly of the bore, the plunger being movable inwardly by the action of an engine driven cam to displace fuel from the pumping chamber through said outlet, a port having a predetermined diameter formed in the wall of the bore, said port being positioned to be covered by the plunger during the initial inward movement of the plunger, and groove means formed in a side wall of the plunge, said groove means including an inclined control edge, a longitudinal groove, and a circumferential groove including an inner edge proximally located to the control edge and the longitudinal groove and an outer edge spaced apart from the inner edge, the control edge and the longitudinal groove, said inclined control edge being positioned to uncover said port at a predetermined position during inward movement of the lunger depending upon the angular setting of the plunger within the bore, said longitudinal groove connecting the groove means with said pumping chamber to thereby define a fuel flow channel, and said circumferential groove having a predetermined axial width defined by the space between the inner and outer edges, the predetermined axial width chosen such that the predetermined axial width is smaller than the port diameter and such that the lower edge obstructs at least a portion of the port when the plunger moves inwardly toward its innermost position to restrict fuel flow through the port and to increase fluid pressure in the bore for damping the final inward movement of the plunger and restricting further inward movement of the plunger.

* * * * *